United States Patent [19]

Ono et al.

[11] Patent Number: 4,618,563

[45] Date of Patent: Oct. 21, 1986

[54] PHOTOGRAPHIC LIGHT-SENSITIVE MATERIAL

[75] Inventors: Mitsunori Ono; Isamu Itoh; Keiji Mihayashi, all of Kanagawa, Japan

[73] Assignee: Fuji Photo Film Co., Ltd., Kanagawa, Japan

[21] Appl. No.: 641,101

[22] Filed: Aug. 15, 1984

[30] Foreign Application Priority Data

Aug. 15, 1983 [JP] Japan ..... 58-148980

[51] Int. Cl.[4] ..... G03C 1/40; G03C 5/54; G03C 1/08; G03C 1/34

[52] U.S. Cl. ..... 430/219; 430/212; 430/218; 430/222; 430/223; 430/443; 430/543; 430/559; 430/562; 430/564; 430/566; 430/598; 430/611; 430/614; 430/955; 430/957; 430/958; 430/959

[58] Field of Search ..... 430/218, 219, 443, 611, 430/614, 955, 957, 958, 959, 212, 222, 223, 559, 566, 598, 562, 564, 543

[56] References Cited

U.S. PATENT DOCUMENTS

| | | | |
|---|---|---|---|
| 3,888,677 | 6/1975 | Abele et al. | 430/611 |
| 4,263,393 | 4/1981 | Chen | 430/559 |
| 4,350,752 | 9/1982 | Reczek et al. | 430/219 |
| 4,363,865 | 12/1982 | Reczek et al. | 430/559 |
| 4,410,618 | 10/1983 | Van Meter et al. | 430/957 |

*Primary Examiner*—Richard L. Schilling
*Attorney, Agent, or Firm*—Sughrue, Mion, Zinn, Macpeak, and Seas

[57] ABSTRACT

A silver halide photographic light-sensitive material is described, comprising a support having thereon a light-sensitive silver halide emulsion layer having associated therewith a blocked photographic agent represented by formula (I)

wherein A represents a photographically useful agent moiety, which may have a timing group; $X^1$ and $X^2$ each represents a carbonyl group, a sulfonyl group, or a sulfinyl group; Z represents an atomic group forming a 5-membered, 6-membered, or 7-membered ring; $R^1$ and $R^2$, which may be the same or different, each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3. The precursor of photographic agent is completely stable during the preservation of the photographic light-sensitive material and releases a photographically useful agent at a desired time during processing of the photographic light-sensitive material. The precursor can exhibit its function to a substantial degree under mild conditions, such as in a pH range of from 9 to 12.

34 Claims, No Drawings

PHOTOGRAPHIC LIGHT-SENSITIVE MATERIAL

FIELD OF THE INVENTION

The present invention relates to a silver halide photographic light-sensitive material, and more particularly, to a photographic light-sensitive material comprising a light-sensitive silver halide emulsion layer having associated therewith a blocked photographic agent capable of releasing a photographically useful agent.

BACKGROUND OF THE INVENTION

Photographically useful agents that are incorporated in a photographic light-sensitive material such that their effects will be produced at the appropriate time contain various features different from those which are used as an addition to a processing solution. Specific examples of such features in the former case are as follows. First, the incorporation in a photographic light-sensitive material enables effective utilization of photographic agents of kinds which tend to decompose under the acidic, alkaline, or oxidation-reduction conditions, and consequently, cannot withstand long time storage in a processing bath. At the same time, such makes it possible to simplify the composition of the processing solution to be employed therewith, and thereby to facilitate the preparation of the processing solution. Further, this makes it possible to force a required photographic agent to function at a desired time during the photographic processing, or only at a desired place, that is, in only a specified layer and the neighboring layers of a multilayer photographic light-sensitive material. Furthermore, this permits the presence of a photographic agent in the photographic light-sensitive material in such an amount as to vary as the function of silver halide development. However, if a photographic agent is added to a photographic light-sensitive material in its active form, it becomes impossible to make the photographic agent exhibit its ability to the expected degree, because during storage before photographic processing, it reacts with other components contained in the photographic light-sensitive material, or it is decomposed by heat, oxygen, etc.

One method for solving the above-described problem involves adding a photographic agent to a photographic light-sensitive material in such a form that its active group is blocked and turned photographically inactive, that is, it is present in the form of a precursor. Such a method can have various advantages in various cases to which it is applicable. For instance, in the case where the useful photographic agent is a dye, blocking a functional group of the dye, which has a great effect on its spectral absorption characteristic, results in a shift of its spectral absorption band to shorter wavelengths or to longer wavelengths and therefore, even if the dye is present in a silver halide emulsion layer having the spectral sensitivity in the wavelength region corresponding to the absorption band which the dye has in the unblocked state, a lowering of the sensitivity due to the so-called filter effect can be prevented.

In another case, wherein the useful photographic agent is an antifoggant or a development restrainer, blocking of the active groups makes it possible to suppress desensitization arising from adsorption of these agents to light-sensitive silver halide grains and formation of silver salts upon storage. At the same time, release of these agents at required times permits the reduction of fog density without being attended by a decrease in the sensitivity, the prevention of fog due to overdevelopment, development stoppage at a desired time, and so on.

In still another case, wherein the useful photographic agent is a developing agent, an auxiliary developing agent, or a fogging agent, if their active or adsorptive groups are blocked, various photographically adverse effects which arise from semiquinones and oxidants produced by air oxidation upon storage can be prevented. Generation of fogging nuclei upon storage can also be prevented because injection of electrons into the silver halide grains can be inhibited. Therefore, stable processings can be effected therein.

In a further case, viz., that the useful photographic agent is a bleach accelerating agent or a bleach-fix accelerating agent, it also becomes possible to prevent reactions with other components also present in the photographic light-sensitive material from occurring upon storage by blocking its active group, and that, to make its expected ability bring into full play at a desired time by removing the blocking group.

As described above, a precursor of photographic agents can be utilized as an extremely valuable tool in bringing out the abilities of the photographic agents to best advantage. However, the precursor must satisfy very severe requirements for practical use. That is, the precursor must satisfy two requirements that are somewhat contradictory to each other; one is ensuring stable presence of the precursor under a storage condition, and the other is setting its blocking group loose at a desired time during the processing and releasing the photographic agent rapidly and efficiently.

A number of techniques for blocking a photographic agent are already known. For instance, a technique using a blocking group such as an acyl group, a sulfonyl group or the like is described in U.S. Pat. No. 3,615,617; a technique which utilizes such a blocking groups as to release a photographic agent by the so-called reversal Michael reaction is described in U.S. Pat. Nos. 3,674,478, 3,791,830 and 4,009,029; a technique which utilizes such a blocking group as to release a photographic agent with the production of quinone methide or its analogs by intramolecular electron transfer is described in U.S. Pat. Nos. 3,674,478, 4,416,977 and 4,420,554; a technique which utilizes an intramolecular ring-closing reaction is described in U.S. Pat. No. 4,310,612; a technique which utilizes cleavage of a 5-membered or 6-membered ring is described in U.S. Pat. Nos. 4,335,200 and 4,350,752 and Japanese Patent Application (OPI) 179842/82 (the term "OPI" as used herein refers to a "published unexamined Japanese patent application"); and so on. However, these photographic agents blocked with known blocking groups suffer from certain defects; for example, although stable under storage conditions, some precursors require a highly alkaline condition, such as a pH higher than 12, for processing because the photographic agent-releasing rate thereof is too slow; some precursors decompose gradually losing their function as the precursor under storage conditions, even though it can release the photographic agent at a sufficiently fast rate by processing under mild conditions such as at a pH in the range of 9 to 12.

SUMMARY OF THE INVENTION

An object of the present invention is, therefore, to provide a blocked photographic agent which is completely stable under storage conditions and can release a photographic agent at a desired time during processing.

Another object of the present invention is to provide a blocked photographic agent which can satisfy the contradictory requirements, that is, stability under storage conditions and release of the photographically useful agent even by processing at a relatively low pH, such as from 9 to 12.

Other objects of the present invention will become apparent from the following detailed description and examples.

These objects of the present invention are attained by a silver halide photographic light-sensitive material comprising a support having thereon a light-sensitive silver halide emulsion layer having associated therewith a blocked photographic agent represented by formula (I)

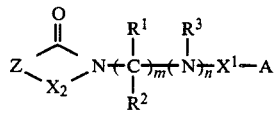

(I)

wherein A represents a photographically useful agent moiety, which may have a timing group; $X^1$ and $X^2$ each represents a carbonyl group, a sulfonyl group or a sulfinyl group; Z represents an atomic group forming a 5-membered, 6-membered, or 7-membered ring; $R^1$ and $R^2$, which may be the same or different, each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total number of m+n is 1, 2, or 3.

DETAILED DESCRIPTION OF THE INVENTION

The blocked photographic agents represented by formula (I) used in the present invention are described in detail hereinafter.

In formula (I), A represents a photographically useful agent moiety which may have a timing group. Examples of the photographically useful agents include known photographic agents which are bonded through a hetero atom, for example, antifoggants and development restrainers, such as mercaptotetrazoles, mercaptotriazoles, mercaptopyrimidines, mercaptobenzimidazoles, mercaptothiadiazoles, benzotriazoles, and imidazoles; developing agents, such as p-phenylenediamines, hydroquinones, and p-aminophenols; auxiliary developing agents, such as pyrazolidones; fogging agents, such as hydrazines or hydrazides; silver halide solvents such as sodium thiosulfate, etc.; bleach accelerating agents such as aminoalkylthiols; and dyes such as azo dyes and azomethine dyes. In addition, photographic agents of the kind which further possess such a redox function as to enable the release of photographic agents as described above as a function of silver halide development, for example, coloring materials for color diffusion transfer photographic materials and DIR (development inhibitor releasing) hydroquinones, can also be employed as useful photographic agents.

The above-described photographically useful agents may be bonded through a timing group. Examples of the timing group include one which releases the photographically useful agent by an intramolecular ring-closing reaction, as described in Japanese Patent Application (OPI) No. 145135/79; one which releases the photographically useful agent through intramolecular electron transfer, as described in British Pat. No. 2,072,363, Japanese Patent Application (OPI) No. 154234/82, etc.; one which releases the photographically useful agent with the evolution of carbon dioxide, as described in Japanese Patent Application (OPI) No. 179842/82; one which releases the photographically useful agent with the evolution of formaldehyde, as described in Japanese Patent Application (OPI) No. 93442/84; and so on.

Z represents an atomic group forming a 5-membered, 6-membered, or 7-membered ring. Specific examples of the atomic groups include an alkylene group, a cycloalkylene group, an alkenylene group, an arylene group, an aralkylene group, an oxyalkylene group, a thioalkylene group, an aminoalkylene group, and a heterocyclene group, etc.

Of the compounds represented by formula (I) according to the present invention, more preferred compounds are those represented by formulae (II) and (III)

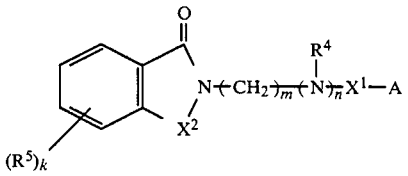

(II)

wherein A represents a photographically useful agent moiety; $X^1$ and $X^2$ each represents a sulfonyl group or a carbonyl group; $R^4$ represents a substituent selected from an alkyl group, an alkenyl group, a cycloalkyl group, a heterocyclic group, an aryl group, and an aralkyl group; $R^5$ represents a substituent selected, preferably, from a halogen atom, an alkyl group, an alkenyl group, an aralkyl group, an aryl group, an alkoxy group, an amino group, a hydroxy group, a carboxy group, an alkyloxycarbonyl group, an aryloxycarbonyl group, a carbonamido group, a sulfonamido group, a ureido group, a sulfamoylamino group, an oxycarbonamido group, a carbamoyl group, a sulfamoyl group, a sulfonyl group, a cyano group, a sulfo group, and a nitro group; m represents 0, 1, or 2; n represents 0 or 1; k represents 0, 1, 2, 3, or 4 and when k represents 2, 3, or 4, the $R^5$ groups may be the same or different,

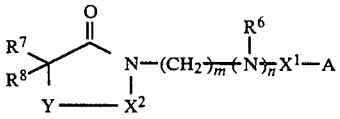

(III)

wherein A represents a photographically useful agent moiety; $X^1$ and $X^2$ each represents a sulfonyl group or a carbonyl group; $R^6$ represents a substituent selected from an alkyl group, an alkenyl group, a cycloalkyl group, a heterocyclic group, an aryl group, and an aralkyl group; $R^7$ and $R^8$, which may be the same or different, each represents a substituent selected, preferably, from a hydrogen atom, a halogen atom, and an alkyl group; Y represents an oxygen atom, a sulfur atom,

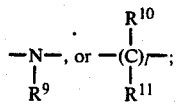

$R^9$ represents a substituent selected from an alkyl group, an alkenyl group, a cycloalkyl group, a heterocyclic group, an aryl group, and an aralkyl group; $R^{10}$ and $R^{11}$ each represents a hydrogen atom, a halogen atom, an alkyl group, an alkoxy group, or an aryl group, etc.; l represents 1 or 2, when l represents 2, the $R^{10}$ and $R^{11}$ groups attached to the two carbon atoms may be the same or different, or they may form a double bond between the two carbon atoms, and when l represents 1, $R^{10}$ and $R^{11}$ may form a double bond between the carbon atom substituted with $R^{10}$ and $R^{11}$ and the carbon atom substituted with $R^7$ and $R^8$, or $R^7$, $R^8$, $R^{10}$, and $R^{11}$ may be bonded each other to form a ring or a hetero ring; m represents 0, 1, or 2; and n represents 0 or 1.

Particularly preferred compounds include those represented by formula (II) wherein $X^1$ represents a carbonyl group; $X^2$ represents a carbonyl group or a sulfonyl group; $R^4$ represents a substituted or unsubstituted alkyl group; $R^5$ represents a halogen atom, a carbonamido group, a sulfonamido group, a ureido group, a carbamoyl group, a sulfamoyl group, or a nitro group; k represents 0, 1, or 2, preferably 0 or 1; m represents 0, 1, or 2, more preferably 1 or 2; and n represents 0 or 1, and when n represents 0, m represents preferably 2 and when n represents 1, m represents preferably 1.

Particularly preferred compounds further include those represented by formula (III) wherein $X^1$ and $X^2$ each represents a carbonyl group; $R^6$ represents a substituted or unsubstituted alkyl group; Y represents an oxygen atom or

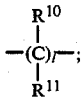

$R^{10}$ and $R^{11}$ each represents a hydrogen atom; l represents 1; $R^7$ and $R^8$ each represents a hydrogen atom or a substituted or unsubstituted alkyl group; m represents 0, 1, or 2, more preferably 1 or 2; and n represents 0 or 1, and when n represents 0, m represents preferably 2 and when n represents 1, m represents preferably 1.

The reasons why the precursor compounds according to the present invention have excellent stability under storage conditions but can rapidly release photographically useful agents at a desired time during processing are not entirely clear, but the following factors may be significant. First, it is thought that the mechanism of releasing a photographically useful agent from the precursor compound according to the present invention may occur in the manner as shown in the Reaction Scheme 1 described below. In the reaction scheme the case wherein $X^1$ and $X^2$ each represents a carbonyl group in formula (I) is shown, but the case wherein $X^1$ and $X^2$ each represents a sulfonyl group could be set forth in an analogous manner.

REACTION SCHEME 1

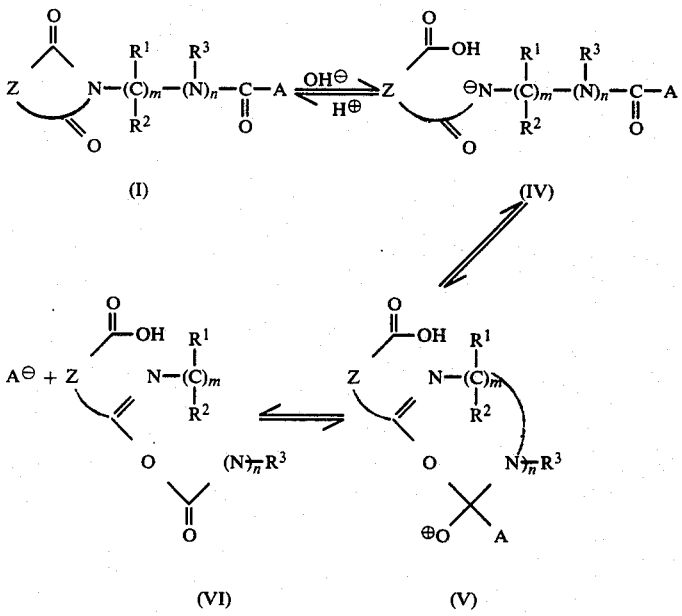

In the above-described Reaction Scheme 1, A, Z, $R^1$, $R^2$, $R^3$, m and n each has the same meaning as defined for formula (I).

With reference to Reaction Scheme 1, it can be explained that the processes from Compound (I) to Compound (VI) are all reversible reactions and even when Compound (IV) or (V) is partially formed the reactions returning to Compound (I) preferentially occur resulting in the suppression of the release of $A^{\ominus}$ since the pH is between 6 and 7 in film layers under storage conditions. On the other hand, it is considered that the release of $A^{\ominus}$ is extremely accelerated under an alkaline condition of the time of processing since the equilibrium between the compounds is inclined toward Compound (VI). In the case wherein $A^{\ominus}$ represents a photographically useful agent moiety having a timing group it is believed to be more advantageous in view of the stability under storage conditions, because the cleavage reaction of the timing group is further required in succession to the reactions from Compound (I) to Compound (VI) in order to release a photographically useful agent.

A preferred addition amount of the compound according to the present invention can be varied depending on the kind of the photographically useful agent. For instance, in the case of an antifoggant or a development restrainer, a preferred addition amount of its precursor ranges from $10^{-8}$ mol to $10^{-1}$ mol per mol of silver. More specifically, in the case of an antifoggant of mercapto group-containing type it ranges from $10^{-6}$ mol to $10^{-1}$ mol per mol of silver, and in the case of an antifoggant of the azole type, such as a benzotriazole, etc., it ranges from $10^{-5}$ mol to $10^{-1}$ mol per mol of silver. In the case of a developing agent, it ranges from $10^{-2}$ mol to 10 mols, and preferably from 0.1 mol to 5 mols, per mol of silver. In the case of an auxiliary developing agent of pyrazolidone type, it ranges from $10^{-4}$ mol to 10 mols, and preferably from $10^{-2}$ mol to 5 mols, per mol of silver. In the case of a fogging agent, it ranges from $10^{-2}$ mol to $10^{-6}$ mol, preferably from $10^{-3}$ mol to $10^{-5}$ mol, per mol of silver. In the case of a silver halide solvent such as sodium thiosulfate, etc., it ranges from $10^{-3}$ mol to 10 mols, and preferably from $10^{-2}$ mol to 1 mol, per mol of silver. In the case of a bleach accelerating agent such as an aminoethanethiol, etc., it ranges from $10^{-5}$ mol to 0.1 mol, and preferably from $10^{-4}$ mol to $10^{-2}$ mol, per mol of silver. In the case of a dye or a coloring material for a color diffusion transfer photographic material, it ranges from $10^{-3}$ mol to 1 mol, preferably from $5\times10^{-3}$ mol to 0.5 mol, per mol of silver.

Specific examples of the blocked photographic agents, capable of releasing a photographically useful agent which can be used in the present invention are set forth below, but the present invention should not be construed as being limited thereto.

(1)

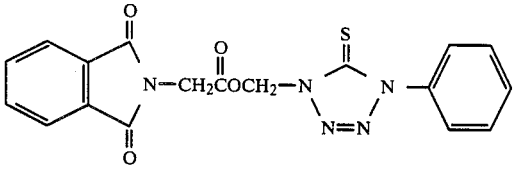

(2)

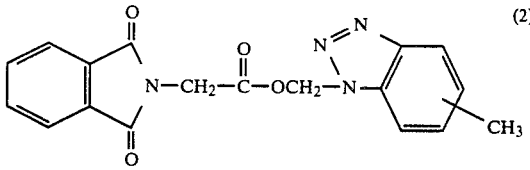

(3)

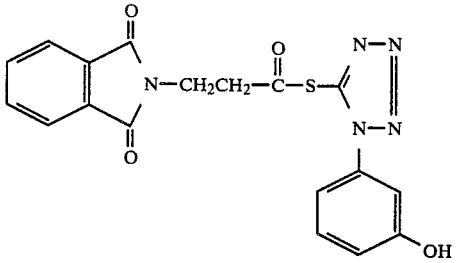

(4)

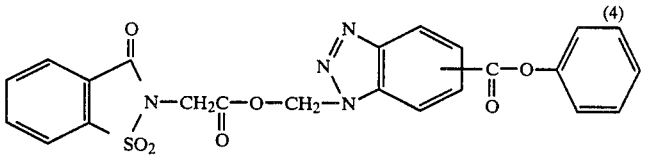

(5)

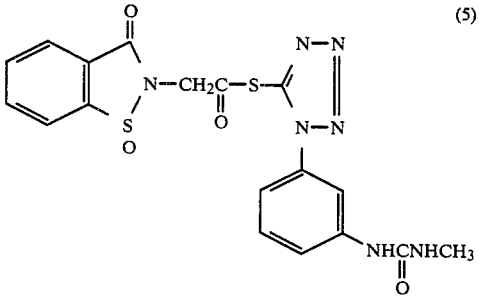

(6)

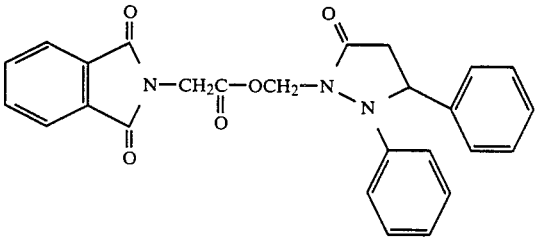

-continued
(7)
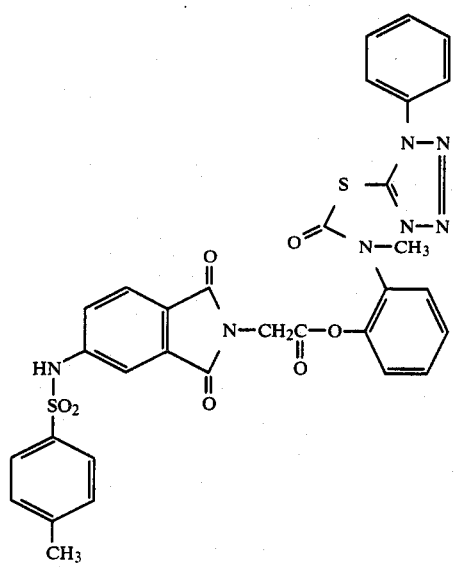
(8)
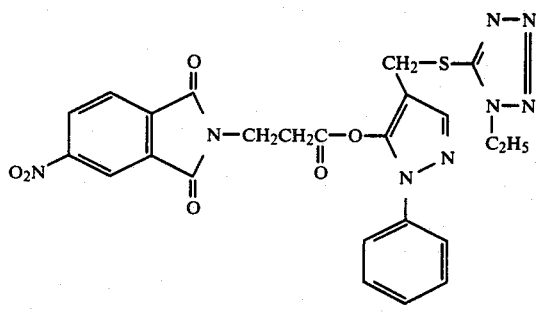
(9)
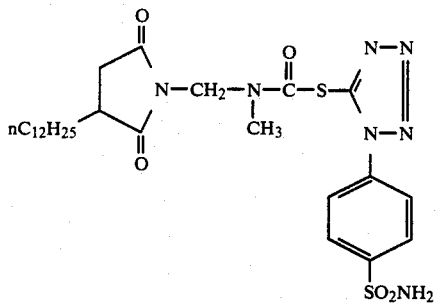
(10)
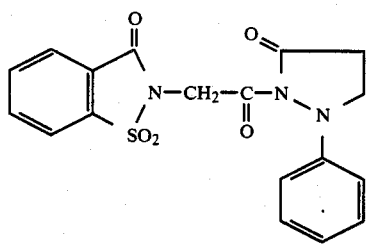
(11)
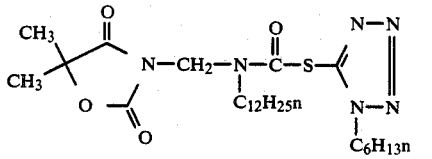
(12)
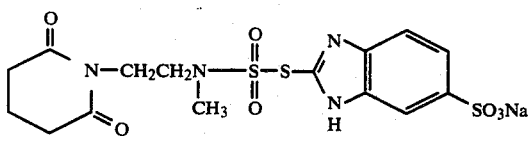
(13)
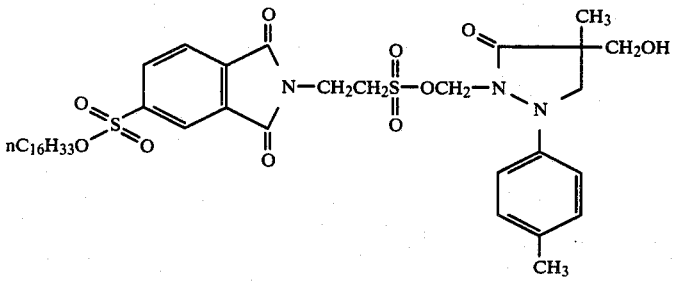
(14)
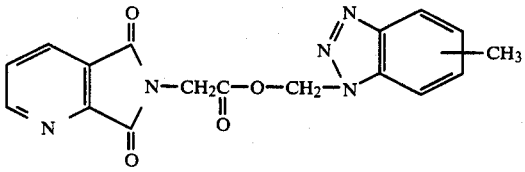
(15)
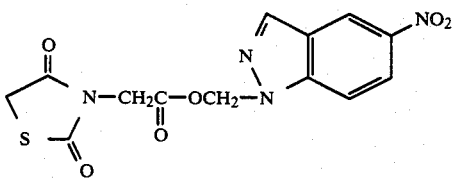

-continued
(16)
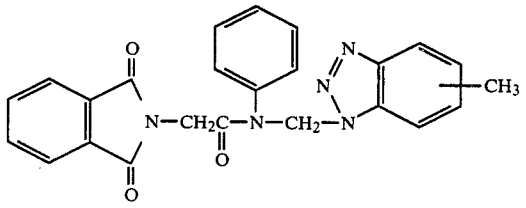
(17)
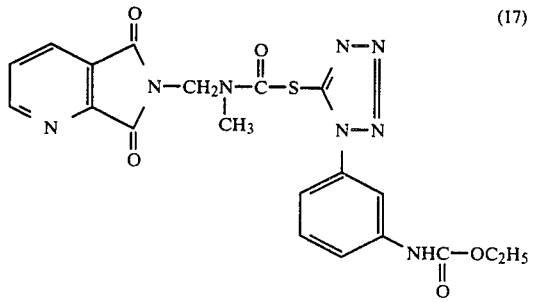
(18)
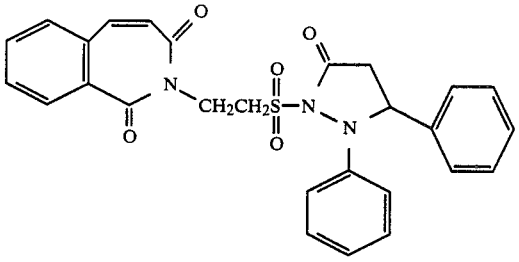
(19)
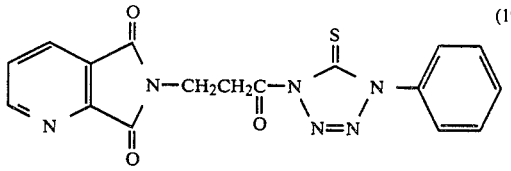
(20)
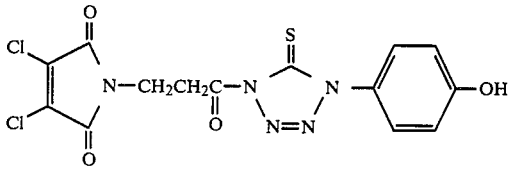
(21)
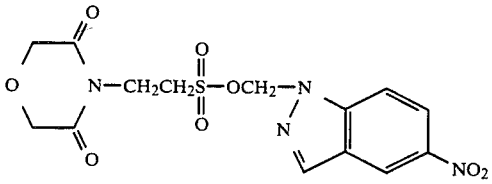
(22)
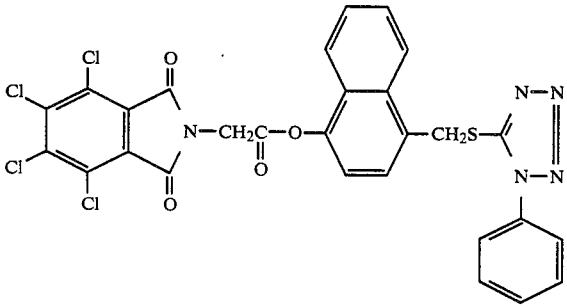
The precursor compounds represented by formula (I) according to the present invention can be easily synthesized, for example, using such methods as illustrated by the following Reaction Schemes 2 and 3.
REACTION SCHEME 2
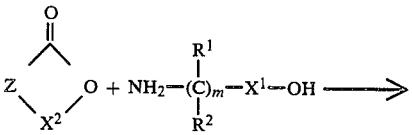
(VII) (VIII)
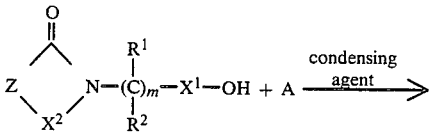
(IX)
-continued
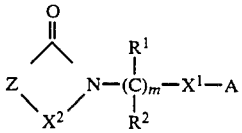
(I) (n = 0)
REACTION SCHEME 3
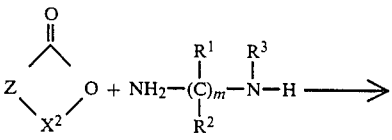
(VII) (X)

-continued

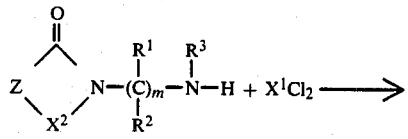

(XI)

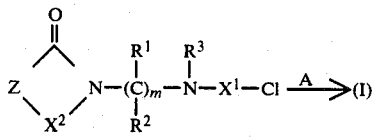

(XII) (n = 1)

In the Reaction Schemes 2 and 3, A, $X^1$, $X^2$, $R^1$, $R^2$, $R^3$, Z, m and n each has the same meaning as defined for formula (I).

That is, in the case wherein n is 0 as set forth in Reaction Scheme 2, an imide (IX) is obtained by dehydrating condensation with heating of an anhydride (VII) and an amine (VIII), and then the imide (IX) is reacted with a photographically useful agent, or a photographically useful agent having a timing group, in the presence of a dehydrating agent, for example, dicyclohexylcarbodiimide, etc., to obtain Compound (I) (n=0).

Further, in the case wherein n is 1 as set forth in Reaction Scheme 3, an imide (XI) is obtained by condensation reaction of a diamino compound (X) with an anhydride (VII), then the imide (XI) is converted to a carbamic chloride (XII) using phosgene or thiophosgene and the carbamic chloride is subjected to substitution reaction with a photographically useful agent or a photographically useful agent having a timing group to obtain Compound (I) (n=1).

Specific synthesis examples of the precursor compounds according to the present invention are set forth below.

SYNTHESIS EXAMPLE 1

Synthesis of Compound (2)

11.64 g (0.06 mol) of N-phthaloyl glycine obtained by dehydration reaction of phthalic anhydride and glycine, 9.78 g (0.06 mol) of 1-hydroxymethyl-5-methylbenzotriazole and a catalytic amount of 4-dimethylaminopyridine were dissolved in 300 ml of dimethylformamide and the solution was cooled to 0° C., to which was added dropwise 50 ml of a dimethylformamide solution containing 13.4 g (0.065 mol) of dicyclohexylcarbodiimide. After the completion of the dropwise addition, the cooling bath was removed, the mixture was stirred at room temperature for 3 hours and then allowed to stand overnight. The reaction mixture was cooled and the urea thus-formed was removed by filtration. The filtrate was poured into water and extracted with ethyl acetate. The organic layer was washed with water and dried with anhydrous sodium sulfate. After distilling off the solvent, ether was added to the residue to obtain 19 g of crude crystals. By recrystallization from a solvent mixture of ethyl acetate and hexane, 14.5 g of the desired compound having a melting point of 162° to 164° C. was obtained.

SYNTHESIS EXAMPLE 2

Synthesis of Compound (6)

11.64 g (0.06 mol) of N-phthaloyl glycine, 16.02 g (0.06 mol) of 1,5-diphenyl-2-hydroxymethyl-3-oxopyrazolidine and a catalytic amount of 4-dimethylaminopyridine were dissolved in 200 ml of dimethylformamide and the solution was cooled to which was added dropwise 50 ml of a dimethylformamide solution containing 13.4 g (0.065 mol) of dicyclohexylcarbodiimide. After the completion of the dropwise addition, the cooling bath was removed, the mixture was allowed to stand overnight at room temperature. The reaction mixture was cooled and the urea thus-formed was removed by filtration. The filtrate was poured into water and extracted with ethyl acetate. The organic layer thus-obtained was washed with water and dried with anhydrous sodium sulfate. After distilling off the solvent, ether was added to the residual oily product to obtain crude crystals. By recrystallization from a solvent mixture of ethyl acetate and hexane, 19 g of the desired compound was obtained as white crystals having a melting point of 175° to 177° C.

SYNTHESIS EXAMPLE 3

Synthesis of Compound (14)

Step 1: Synthesis of (Pyridine-2,3-dicarboxyimidoyl) Acetic Acid

A mixture of 25 g (0.168 mol) of pyridine-2,3-dicarboxylic anhydride, 12.6 g (0.168 mol) of glycine, 1.7 g (0.0168 mol) of triethylamine and 200 ml of toluene was refluxed by heating for 8 hours while continuously removing the water formed. The reaction mixture was filtered while it was still hot to remove the insoluble substance and the filtrate was cooled to obtain crystals. The crystals were recrystallized from a solvent mixture of ethyl acetate and hexane to obtain 19 g of the desired compound having a melting point of 133° to 135° C.

Step 2: Synthesis of Compound (14)

30 g (0.146 mol) of (pyridine-2,3-dicarboxyimidoyl) acetic acid, 23.7 g (0.146 mol) of 1-hydroxymethyl-5-methylbenzotriazole and a catalytic amount of 4-dimethylaminopyridine were dissolved in 400 ml of dimethylformamide and the solution was cooled to which was added dropwise 100 ml of a dimethylformamide solution containing 36.1 g of dicyclohexylcarbodiimide. After the completion of the dropwise addition, the cooling bath was removed, and the mixture was allowed to stand for 2 days at room temperature. The reaction mixture was cooled and the urea thus-formed was removed by filtration. The filtrate was poured into water and extracted with chloroform. The organic layer thus-obtained was washed with water and dried with anhydrous sodium sulfate. After distilling off the solvent, the crude crystals thus-formed were recrystallized from a solvent mixture of ethyl acetate and ether to obtain 46 g of the desired compound having a melting point of 199° to 201° C.

SYNTHESIS EXAMPLE 4

Synthesis of Compound (16)

Step 1: Synthesis of 5-Methyl-1-anilinomethylbenzotriazole 5.0 g (0.03 mol) of 1-hydroxymethyl-5-methylbenzotriazole and 2.9 g (0.03 mol) of aniline were suspended in ethanol and refluxed for 1 hour. The insoluble substance was removed by filtration while it was still hot and the filtrate was cooled to obtain crude crystals. By recrystallization of the crude crystals from ethanol 4.2 g of the desired compound having a melting point of 149° to 152° C. was obtained.

Step 2: Synthesis of Compound (16)

1.27 g ($6.55\times10^{-3}$ mol) of N-phthaloyl glycine and 1.56 g ($6.55\times10^{-3}$ mol) of 5-methyl-1-anilinomethylbenzotriazole were dissolved in 50 ml of dimethylformamide and the solution was cooled to which was added dropwise 10 ml of dimethylformamide solution containing 1.4 g ($6.8\times10^{-3}$ mol) of dicyclohexylcarbodiimide. After the completion of the dropwise addition, the mixture was stirred at 0° C. for 5 hours. The urea thusformed was removed by filtration and the filtrate was poured into water and extracted with ethyl acetate. The organic layer was washed with water and dried with anhydrous sodium sulfate. The solvent was distilled off and the residual oily product was separated and purified by flash column chromatography to obtain 430 mg of the desired compound as white crystals having a melting point of 127° to 135° C.

The precursors according to the present invention can be used in combinations of two or more thereof.

The blocked photographic agents (precursors) according to the present invention may be added to any constituent layers of a silver halide photographic light-sensitive material including a silver halide emulsion layer, a coloring material layer, a subbing layer, a protective layer, an interlayer, a filter layer, an antihalation layer, an image-receiving layer, a cover sheet layer and other subsidiary layers.

Incorporation of the precursors used in the present invention into the above-described layers can be carried out by adding them to coating solutions for forming such layers directly (as is), or in such a state that they are dissolved in a proper concentration in a solvent as not to affect adversely the photographic light-sensitive material; examples of such solvents include water, alcohol, etc. Also, the precursors can be added in such a state that they are first dissolved in an organic solvent having a high boiling point and/or an organic solvent having a low boiling point, and then emulsified and dispersed in an aqueous solution. Moreover, they may be added in such a state that they are loaded into polymer latexes using the methods as described in Japanese Patent Application (OPI) Nos. 39853/76, 59942/76 and 32552/79, U.S. Pat. No. 4,199,363, etc.

The precursors may be added at any stages of the production of the photographic light-sensitive material. However, it is generally preferable to choose the stage of just before the coating.

The compound according to the present invention can be applied, for example, to color photographic light-sensitive materials of the coupler type.

A general method for forming color images using a color photographic light-sensitive material comprises developing a silver halide photographic light-sensitive material with an aromatic primary amine developing agent in the presence of a color coupler which has such an ability as to form a dye by reacting with the oxidation product of developing agent, to produce an azomethine dye or an indoaniline dye. The basis of the above-described color development method was developed by L. D. Mannes and L. Godowsky in 1935, and thereafter, various improvements have been introduced thereinto. Nowadays, this color development method is virtually universally employed in this art.

In this method, the subtractive color process is usually employed for color reproduction, wherein silver halide emulsions which are sensitive selectively to blue, green, and red light, respectively, and yellow, magenta, and cyan color image forming agents which bear respective complementary relations to such color lights are used. In order to form yellow color images, couplers of, e.g., acylacetanilide type or dibenzoylmethane type are used. In order to form magenta color images, couplers of pyrazolone type, pyrazolobenzimidazole type, cyanoacetophenone type or indazolone type are predominantly used. In order to form cyan color images, couplers of phenol type, e.g., phenols and naphthols, are predominantly used.

In general, color photographic light-sensitive materials are divided broadly into two main groups; one group consists of the coupler-in-developer type, which utilizes couplers added to a developing solution, and the other group consists of those of the coupler-in-emulsion type, which contains couplers in their light-sensitive emulsion layers. In the latter materials, dye image forming couplers are incorporated in silver halide emulsion layers. For couplers to be added to emulsion layers, it is necessary to be rendered nondiffusible (diffusion resistant) in the matrix of emulsion binder.

The processing steps of color photographic light-sensitive materials of the incorporated coupler type comprises basically of the following three steps.

(1) Color development step
(2) Bleaching step
(3) Fixing step

A bleaching step and a fixing step may be carried out at the same time. Such is called a bleach-fixing (blixing) step, and both developed silver and undeveloped silver halide are desilvered in this step. Besides involving the above-described two basic steps, the color development step and the desilvering step, the actual processing for development processing includes auxiliary steps for the purposes of retaining the photographic and physical qualities of the image, improving the storability of the image, and so on. For instance, there are steps using a hardening bath for preventing photographic layers from being excessively softened during the processing, a stop bath for stopping a development reaction effectively, an image stabilizing bath for stabilizing images formed, a layer-removing bath for removing a backing layer from the support, and so on.

Couplers are added to or dispersed into gelatin silver halide emulsions or hydrophilic colloid according to conventionally known methods. Specifically, methods that can be used include: a method dispersing a coupler in the form of a mixture with an organic solvent having a high boiling point such as dibutyl phthalate, tricresyl phosphate, waxes, a higher fatty acid or its ester, etc., as described, e.g., in U.S. Pat. Nos. 2,304,939 and 2,322,027, and so on; a method of dispersing a coupler in the form of a mixture with an organic solvent having a low boiling point or a water-soluble organic solvent; a method of dispersing a coupler in the form of a mixture with a combination of an organic solvent having a high boiling point and an organic solvent having a low boiling point, as described, e.g., in U.S. Pat. Nos. 2,801,170, 2,801,171 and 2,949,360, and so on; a method of dispersing a coupler by itself or in combination with other couplers required for combined use, such as a colored coupler and an uncolored coupler, where the coupler per se has a low melting point (e.g., not higher than 75° C.), as described in German Pat. No. 1,143,707; etc.

Suitable examples of a dispersing aid which can be employed for dispersion of couplers include conventionally used surface active agents, for example, anionic surface active agents (e.g., sodium alkylbenzenesulfonates, sodium dioctylsulfosuccinate, sodium dodecylsulfate, sodium alkylnaphthalenesulfonates, Fischer type couplers, etc.), amphoteric surface active agents (e.g., N-tetradecyl-N,N-dipolyethylene-α-betaine, etc.) and nonionic surface active agents (e.g., sorbitan monolaurate, etc.).

The photographic emulsion layer of the photographic light-sensitive material used in the present invention can contain a color forming coupler, that is, a compound capable of color forming upon oxidative coupling with an aromatic primary amine developing agent (e.g., phenylenediamine derivatives, aminophenol derivatives, etc.) in color development processing. More specifically, suitable examples of magenta coupler which can be used include 5-pyrazolone couplers, pyrazolobenzimidazole couplers, cyanoacetylcumarone couplers, openchain acylacetonitrile couplers, etc. Suitable examples of yellow coupler which can be used include acylacetamide couplers (e.g., benzoylacetanilides, pivaloylacetanilides, etc.), etc. Suitable examples of cyan coupler which can be used include naphthol couplers, phenol couplers, etc. Among these couplers, those which are nondiffusible by containing a hydrophobic group, referred to as a ballast group, in the molecule thereof are preferably employed. These couplers may be either 4-equivalent or 2-equivalent per silver ion. Further, colored couplers having a color correction effect, or couplers capable of releasing a development inhibitor with the advance of development (the so-called DIR couplers) can be employed. Furthermore, non-color forming DIR coupling compounds which can provide colorless products upon the coupling reaction and release development inhibitors can be employed other than DIR couplers.

Upon the application to the color diffusion transfer photographic process, the photographic material according to the present invention may constitute any type of film unit, including the peel-apart type, the integrated type as described in Japanese Patent Publication Nos. 16356/71 and 33697/73, Japanese Patent Application (OPI) No. 13040/75 and British Pat. No. 1,330,524, or the peel apart unneeded type as described in Japanese Patent Application (OPI) No. 119345/82.

Moreover, the compounds according to the present invention can be employed in black-and-white photographic light-sensitive materials. Suitable example of such black-and-white photographic materials include medical X-ray films for direct photographing, black-and-white films for general photographing, lithographic films, scanner films, and so on.

Other features of the silver halide photographic light-sensitive material according to the present invention, such as the method of preparation of silver halide emulsions, halogen composition, crystal habit, grain size, chemical sensitizers, antifoggants, stabilizers, surface active agents, gelatin hardeners, hydrophilic colloid binders, metting agents, dyes, sensitizing dyes, fading preventing agents, color mixing preventing agents, polymer latexes, brighteners, antistatic agents, and the like are not critical in the present invention, and reference can be made to, for example, the description in *Research Disclosure,* Vol. 176, pages 22 to 31 (December, 1978).

There are no particular restrictions with respect to exposure to light and development processing of the silver halide photographic light-sensitive materials according to the present invention. Known methods and processing solutions, for example, those as described in *Research Disclosure,* Vol. 176, pages 28 to 30 (December, 1978) can be utilized in the present invention. The photographic processing may be either the photographic processing for forming silver images (black-and-white photographic processing) or that for forming dye images (color photographic processing) depending on purposes. A processing temperature is usually selected from the range of 18° C. to 50° C. Of course, temperatures lower than 18° C. or those higher than 50° C. may be employed.

Developing solutions to be employed for black-and-white photographic processing can contain known developing agents. Suitable examples of developing agents include dihydroxybenzenes (e.g., hydroquinone), 3-pyrazolidones (e.g., 1-phenyl-3-pyrazolidone), aminophenols (e.g., N-methyl-p-aminophenol), and so on. These developing agents may be employed independently or in combinations of two or more thereof. In addition to the developing agent, a developing solution may generally contain a known preservative, alkali agent, pH buffer, an antifoggant, and, optionally, a dissolution aid, a color toning agent, a development accelerator, a surface active agent, a defoaming agent, a water softener, a hardener, a viscosity providing agent, and so on.

To the photographic emulsion according to the present invention, the so-called "lithographic type" of development processing can be applied. The expression "lithographic type of development" means processing in which in order to effect the photographic reproduction of line images or the photographic reproduction of halftone images by means of dots, dihydroxybenzenes are generally used as a developing agent and the developing step is made to proceed infectiously under the condition that the concentration of sulfite ion is maintained at a low level.

A color developing solution is, in general, an alkaline aqueous solution containing a color developing agent. Suitable examples of color developing agents which can be used include known primary aromatic amine developing agents, such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoetylaniline, 4-amino-3-methyl-N-ethyl-N-β-methoxyethylaniline, etc.).

In addition to the above-described compounds, those described in L. F. A. Mason, *Photographic Processing Chemistry,* pages 226 to 229, Focal Press (1966), U.S. Pat. Nos. 2,193,015 and 2,592,364, and Japanese Patent Application (OPI) No. 64933/73, etc., can be also used as a color developing agent.

After the color development processing, photographic emulsion layers are generally subjected to bleach processing. The bleach processing may be carried out simultaneously with fix processing, or separately therefrom. Suitable examples of bleaching agents include compounds of polyvalent metals such as iron (III), cobalt (III), chromium (VI), copper (II), etc., peracids, quinones, nitroso compounds, and so on.

The present invention is illustrated in more detail with reference to the following examples, but the present invention should not be construed as being limited thereto.

EXAMPLE 1

Measurement for Releasing Rate of Photographically Useful Agent from Precursor Compound A precursor compound ($3.6\times10^{-5}$ mol) was dissolved in 4 ml of acetonitrile, and the solution was added at 25° C. to a mixed solution of 16 ml of acetonitrile and 20 ml of a Britton-Robinson buffer which had been adjusted to pH 10.0 in advance. After a lapse of a predetermined period of time, a given amount of reaction solution was collected and adjusted to pH 6.25 with acetic acid to stop the reaction. The photographically useful agent released was quantitatively determined by high performance liquid chromatography using a stainless steel column (inner diameter: 4 mm and length: 250 mm), silica gel (reversed phase, LS-410 made by Toyo Soda Manufacturing Co., Ltd.), a developer [a mixed solvent of methanol/water (½ by vol) containing 0.2 wt% of acetic acid and 0.2 wt% of triethylamine] and an eluent (the same mixed solvent as the developer).

Base on the obtained value, a pseudo first order reaction rate constant k' was determined, and then a half-life period $t_{\frac{1}{2}}$ was calculated. The half-life period $t_{\frac{1}{2}}$ indicates the time required for one half of the precursor compound to react, and is calculated by the equation $t_{\frac{1}{2}}=0.693/k'$.

The half-life period $t_{\frac{1}{2}}$ was obtained in the same manner as described above with respect to Comparison Compounds 1-A and 1-B. The results thus obtained are shown in Table 1 below.

TABLE 1

Measurement for Releasing Rate of Photographically Useful Agent (acetonitrile/buffer = 1/1, pH = 10.0, at 25° C.)

| Compound No. | k' ($sec^{-1}$) | $t_{\frac{1}{2}}$ (sec) |
|---|---|---|
| (2) (Present Invention) | $2.10\times10^{-4}$ | 3,300 |
| (6) (Present Invention) | $2.59\times10^{-4}$ | 2,670 |
| (14) (Present Invention) | $4.17\times10^{-3}$ | 166 |
| 1-A (Comparison) | $1.53\times10^{-4}$ | 4,530 |
| 1-B (Comparison) | $7.44\times10^{-5}$ | 9,310 |

Comparison Compounds 1-A and 1-B have the following structures.

Comparison Compound 1-A:

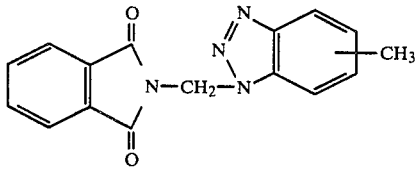

Comparison Compound 1-B:

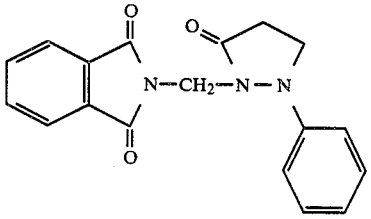

It is apparent from the results shown in Table 1 above that the precursor compounds according to the present invention have a high rate of releasing an antifoggant of a benzotriazole type or a phenidone in comparison with known precursor compounds. Furthermore, they have the excellent stability in coated layers during storage as illustrated in Examples 2 and 3 hereinafter. These facts seem to suggest the above-described multistage mechanism of cleavage.

EXAMPLE 2

In order to evaluate the effectiveness of the antifoggant precursors according to the present invention and the comparison compounds corresponding thereto, Samples A to F were prepared as follows: One of the antifoggant precursors (blocked antifoggants) according to the present invention or one of antifoggants corresponding thereto (for comparison), respectively, which are set forth in Table 2 below, was dissolved in tricresyl phosphate together with the Magenta Coupler (CP-1), emulsified, and added to a silver halide emulsion. The resulting emulsion was coated on a cellulose triacetate film support having a subbing layer. The coated amount of each component was expressed in terms of $g/m^2$ or $mol/m^2$, and is indicated in parentheses.

(1) EMULSION LAYER

Negative type silver iodobromide emulsion having a grain size of 1.4μ (silver: $1.6\times10^{-2}$ $mol/m^2$)
Magenta Coupler Cp-1 ($1.3\times10^{-3}$ $mol/m^2$)
Antifoggant or antifoggant precursor according to the present invention (as shown in Table 2)
Gelatin (2.50 $g/m^2$)

(2) PROTECTIVE LAYER

Gelatin (1.30 $g/m^2$)
Sodium salt of 2,4-dichloro-6-hydroxy-s-triazine (0.05 $g/m^2$)

These films were allowed to stand for 14 hours under the conditions of a temperature of 40° C. and a relative humidity of 70%. Thereafter, they were subjected to imagewise exposure for sensitometry, and then to the following color development processing.

| Steps for Color Development Processing | Time | Temperature |
|---|---|---|
| 1. Color Development | 3 min 15 sec | 38° C. |
| 2. Bleaching | 6 min 30 sec | " |
| 3. Water Washing | 2 min | " |
| 4. Fixing | 4 min | " |
| 5. Water Washing | 4 min | " |
| 6. Stabilizing | 1 min | " |

The composition of the processing solutions employed in the above-described color development processing steps are described below.

| Color Developing Solution: | |
|---|---|
| Water | 800 ml |
| 4-(N—Ethyl-N—hydroxyethyl)amino-2-methylaniline Sulfate | 5 g |
| Sodium Sulfite | 5 g |
| Hydroxylamine Sulfate | 2 g |
| Potassium Carbonate | 30 g |
| Potassium Hydrogencarbonate | 1.2 g |
| Potassium Bromide | 1.2 g |
| Sodium Chloride | 0.2 g |
| Trisodium Nitrilotriacetate | 1.2 g |
| Water to make | 1 liter (pH = 10.1) |
| **Bleaching Solution:** | |
| Water | 800 ml |
| Ammonium Ferric Ethylenediaminetetraacetate | 100 g |

-continued

| | |
|---|---|
| Disodium Ethylenediaminetetraacetate | 10 g |
| Potassium Bromide | 150 g |
| Acetic Acid | 10 g |
| Water to make | 1 liter (pH = 6.0) |
| **Fixing Solution:** | |
| Water | 800 ml |
| Ammonium Thiosulfate | 150 g |
| Sodium Sulfite | 10 g |
| Sodium Hydrogensulfite | 2.5 g |
| Water to make | 1 liter (pH = 6.0) |
| **Stabilizing Solution:** | |
| Water | 800 ml |
| Formalin (37%) | 5 ml |
| Driwell ® (surface active agent) | 3 ml |
| Water to make | 1 liter |

The photographic properties thus-obtained are shown in Table 2 below.

TABLE 2

| Sample No. | Antifoggant or Antifoggant Precursor | Amount Added (mol/m$^2$) | Fog | Gamma | Relative* Sensitivity | Maximum Color Density |
|---|---|---|---|---|---|---|
| A (Control) | None | — | 0.15 | 0.79 | 100 | 1.62 |
| B (Present Invention) | (1) | $2.0 \times 10^{-6}$ | 0.07 | 0.72 | 92 | 1.49 |
| C (Present Invention) | (2) | $2.0 \times 10^{-5}$ | 0.10 | 0.78 | 97 | 1.57 |
| D (Present Invention) | (14) | $2.0 \times 10^{-5}$ | 0.07 | 0.77 | 95 | 1.55 |
| E (Comparison) | 2-A | $2.0 \times 10^{-6}$ | 0.04 | 0.35 | 20 | 0.96 |
| F (Comparison) | 2-B | $4.0 \times 10^{-6}$ | 0.05 | 0.51 | 35 | 1.15 |

*Relative sensitivity is shown by a reciprocal of an exposure amount required for obtaining a color density of fog + 0.2 and being taken the sensitivity of Control Sample A as 100.

It is apparent from the results shown in Table 2 above that Samples B to D wherein the precursor compounds according to the present invention are used can depress the fog without an accompanying substantial decrease in the sensitivity. Thus, it is recognized that the precursor compounds according to the present invention are present stably in the layers and can exceptionally decrease the fog without an accompanying desensitization upon the release of an antifoggant at the time of processing.

The antifoggant for comparison and the coupler employed in the above-described samples are set forth below.

Comparison Compound 2-A:

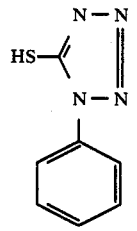

Comparison Coupler 2-B:

-continued

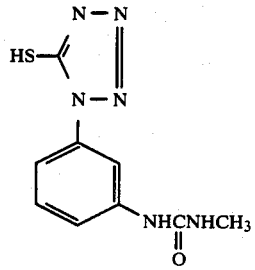

Magenta Coupler Cp-1:

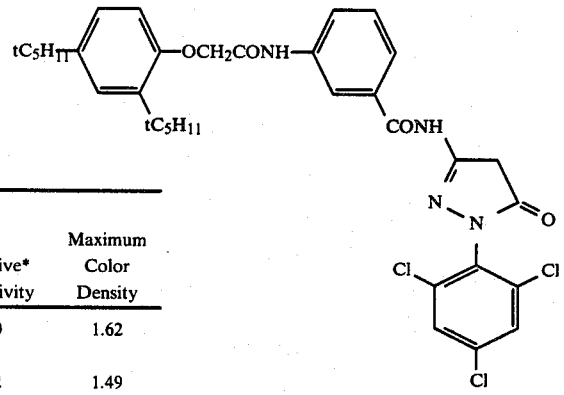

EXAMPLE 3

In order to evaluate the effectiveness of the auxiliary developing agent precursors according to the present invention, and the comparison compounds corresponding thereto, Samples G to K were prepared as follows: One of the auxiliary developing agent precursors (blocked auxiliary developing agents) according to the present invention or one of auxiliary developing agents corresponding thereto (for comparison), respectively, which are set forth in Table 3 below, was dissolved in tricresyl phosphate together with the Magenta Coupler (Cp-1), emulsified and added to a silver halide emulsion. The resulting emulsion was coated on a cellulose triacetate film support having a subbing layer. The coated amount of each component was expressed in terms of g/m$^2$ or mol/m$^2$ designated in parentheses.

(1) EMULSION LAYER

Negative type silver iodobromide emulsion having a grain size of 1.4μ (silver: $1.6\times10^{-2}$ mol/m²)
Magenta Coupler Cp-1 ($1.33\times10^{-3}$ mol/m²)
Auxiliary developing agent or auxiliary developing agent precursor according to the present invention (as shown in Table 3) ($1.33\times10^{-3}$ mol/m²)
Gelatin (2.50 g/m²)

(2) PROTECTIVE LAYER

Gelatin (1.30 g/m²)
Sodium salt of 2,4-dichloro-6-hydroxy-s-triazine (0.05 g/m²)

These films were allowed to stand for 14 hours under the conditions of 40° C. and relative humidity of 70%. Thereafter, they were subjected to exposure for sensitometry, and then to the same color development processing as described in Example 2.

The photographic properties thus-obtained are shown in Table 3 below.

TABLE 3

| Sample No. | Auxiliary Developing Agent or Auxiliary Developing Agent Precursor | Fog | Gamma | Relative* Sensitivity | Maximum Color Density |
|---|---|---|---|---|---|
| G (Control) | None | 0.14 | 0.68 | 100 | 1.61 |
| H (Present Invention) | (6) | 0.14 | 0.78 | 123 | 1.72 |
| I (Present Invention) | (10) | 0.15 | 0.72 | 118 | 1.70 |
| J (Comparison) | 3-A | 0.22 | 0.89 | 80 | 1.73 |
| K (Comparison) | 3-B | 0.17 | 0.86 | 96 | 1.75 |

*Relative sensitivity is shown by a reciprocal of an exposure amount required for obtaining a color density of fog + 0.2 and being taken the sensitivity of Control Sample G as 100.

It is apparent from the results shown in Table 3 above that the occurrence of the increase in fog and the desensitization is observed in the samples for comparison to which the auxiliary developing agents are added directly (as is). On the contrary, Samples H and I, wherein the precursor compounds according to the present invention are used, can increase the sensitivity without accompanying substantial increase in fog.

The auxiliary developing agents for comparison employed in the above-described samples are set forth below.

Comparison Compound 3-A:

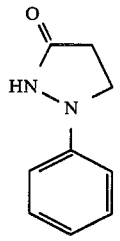

Comparison Compound 3-B:

-continued

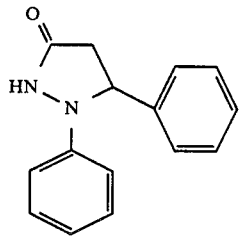

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having thereon a light-sensitive silver halide emulsion layer having associated therewith a blocked photographic agent represented by formula (I)

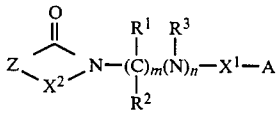

(I)

wherein A represents a photographically useful agent moiety; $X^1$ represents a carbonyl group, a sulfonyl group, or a sulfinyl group, $X^1$ being bonded to A through a heteroatom, and $X^2$ represents a carbonyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3.

2. A silver halide photographic light-sensitive material as in claim 1, wherein the photographically useful agent in the moiety represented by A is an antifoggant, a development restrainer, a developing agent, an auxiliary developing agent, a fogging agent, a silver halide solvent, a bleach accelerating agent, or a dye.

3. A silver halide photographic light-sensitive material as in claim 1, wherein the photographically useful agent moiety represented by A has a timing group.

4. A silver halide photographic light-sensitive material as in claim 1, wherein Z in formula (I) represents an alkylene group, a cycloalkylene group, an alkenylene group, an arylene group, an aralkylene group, an oxyalkylene group, a thioalkylene group, an aminoalkylene group or a heterocyclene group.

5. A silver halide photographic light-sensitive material as in claim 1, wherein the blocked photographic agent is a compound represented by formula (II)

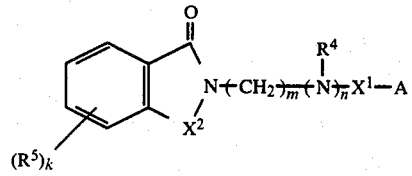

(II)

wherein A represents a photographically useful agent moiety; $X^1$ represents a sulfonyl group or a carbonyl group; $X^1$ being bonded to A through a heteroatom, and $X^2$ represents a carbonyl group; $R^4$ represents a substituent selected from an alkyl group, an alkenyl group, a cycloalkyl group, a heterocyclic group, an aryl group, and an aralkyl group; $R^5$ represents a substituent selected from a halogen atom, an alkyl group, an alkenyl group an aralkyl group, an aryl group, an alkoxy group, an amino group, a hydroxy group, a carboxy group, an alkyloxycarbonyl group, an aryloxycarbonyl group, a carbonamido group, a sulfonamido group, a ureido group, a sulfamoylamino group, an oxycarbonamido group, a carbamoyl group, a sulfamoyl group, a sulfonyl group, a cyano group, a sulfo group, and a nitro group, m represents 0, 1 or 2; n represents 0 or 1; and k represents 0, 1, 2, 3, or 4, and when k represents 2, 3, or 4, the $R^5$ groups may be the same or different, and the total of m+n is 1, 2 or 3.

6. A silver halide photographic light-sensitive material as in claim 1, wherein the blocked photographic agent is a compound represented by formula (III)

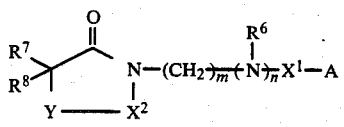

(III)

wherein A represents a photographically useful agent moiety; $X^1$ represents a sulfonyl group or a carbonyl group; $X^1$ being bonded to A through a heteroatom, and $X^2$ represents a carbonyl group; $R^6$ represents a substituent selected from an alkyl group, an alkenyl group, a cycloalkyl group, a heterocyclic group, an aryl group, and an aralkyl group; $R^7$ and $R^8$ each represents a substituent selected from a hydrogen atom, a halogen atom, and an alkyl group; Y represents an oxygen atom, a sulfur atom, or

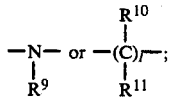

$R^9$ represents a substituent selected from an alkyl group, an alkenyl group, a cycloalkyl group, a heterocyclic group, an aryl group, and an aralkyl group; $R^{10}$ and $R^{11}$ each represents a hydrogen atom, a halogen atom, an alkyl group, an alkoxy group, or an aryl group; l represents 1 or 2, when l represents 2, the $R^{10}$ and $R^{11}$ groups attached to the two carbon atoms may be the same or different, or they may form a double bond between the two carbon atoms, and when l represents 1, $R^{10}$ and $R^{11}$ may form a double bond between the carbon atom substituted with $R^{10}$ and $R^{11}$ and the carbon atom substituted with $R^7$ and $R^8$, or $R^7$, $R^8$, $R^{10}$, and $R^{11}$ may be bonded to each other to form a carbocyclic ring or a heterocyclic ring; m represents 0, 1, or 2; and n represents 0 or 1, and the total of m+n is 1, 2 or 3.

7. A silver halide photographic light-sensitive material as in claim 5, wherein $X^1$ represents a carbonyl group; $R^4$ represents a substituted or unsubstituted alkyl group; $R^5$ represents a halogen atom, a carbonamido group, a sulfonamido group, a ureido group, a carbamoyl group, a sulfamoyl group, or a nitro group; k represents 0, 1, or 2; m represents 0, 1, or 2; and n represents 0 or 1.

8. A silver halide photographic light-sensitive material as in claim 2, wherein the photographically useful agent is an antifoggant or a development restrainer and the blocked photographic agent is contained in the photographic material in an amount of from $10^{-8}$ to $10^{-1}$ mol per mol of silver.

9. A silver halide photographic light-sensitive material as in claim 2, wherein the photographically useful agent is an antifoggant of mercapto group-containing type and the blocked photographic agent is contained in the photographic material in an amount of from $10^{-6}$ to $10^{-1}$ mol per mol of silver.

10. A silver halide photographic light-sensitive material as in claim 2, wherein the photographically useful agent is an antifoggant of the azole type and the blocked photographic agent is contained in the photographic material in an amount of from $10^{-5}$ to $10^{-1}$ mol per mol of silver.

11. A silver halide photographic light-sensitive material as in claim 2, wherein the photographically useful agent is a developing agent and the blocked photographic agent is contained in the photographic material in an amount of from $10^{-2}$ to 10 mols per mol of silver.

12. A silver halide photographic light-sensitive material as in claim 2, wherein the photographically useful agent is an auxiliary developing agent of pyrazolidone type and the blocked photographic agent is contained in the photographic material in an amount of from $10^{-4}$ to 10 mols per mol of silver.

13. A silver halide photographic light-sensitive material as in claim 2, wherein the photographically useful agent is a fogging agent and the blocked photographic agent is contained in the photographic material in an amount of from $10^{-2}$ to $10^{-6}$ mol per mol of silver.

14. A silver halide photographic light-sensitive material as in claim 2, wherein the photographically useful agent is a silver halide solvent and the blocked photographic agent is contained in the photographic material in an amount of from $10^{-3}$ to 10 mols per mol of silver.

15. A silver halide photographic light-sensitive material as in claim 2, wherein the photographically useful agent is a bleach accelerating agent and the blocked photographic agent is contained in the photographic material in an amount of $10^{-5}$ to 0.1 mol per mol of silver.

16. A silver halide photographic light-sensitive material as in claim 2, wherein the photographically useful agent is a dye or a coloring material for a color diffusion transfer photographic material and the blocked photographic agent is contained in the photographic material in an amount of from $10^{-3}$ to 1 mol per mol of silver.

17. A silver halide photographic light-sensitive material as in claim 1, wherein the blocked photographic agent is present in a silver halide emulsion layer.

18. A silver halide photographic light-sensitive material as in claim 1, wherein the blocked photographic agent is present in a coloring material layer, a subbing layer, a protective layer, an interlayer, a filter layer, an antihalation layer, an image-receiving layer or a cover sheet layer.

19. A silver halide photographic light-sensitive material as in claim 1, wherein the photographic material is a silver halide color photographic light-sensitive material containing a color forming coupler.

20. A silver halide photographic light-sensitive material as in claim 1, wherein the photographic material is a color diffusion transfer silver halide photographic light-sensitive material containing a dye-image providing material.

21. A silver halide photographic light-sensitive material as in claim 1, wherein the photographic material is a black-and-white silver halide photographic light-sensitive material which forms a silver image upon black-and-white development.

22. A silver halide photographic light-sensitive material comprising a support having thereon a light-sensitive silver halide emulsion layer having associated therewith a blocked photographic agent represented by formula (I)

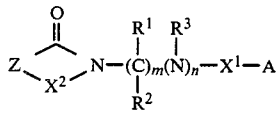

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is an antifoggant or development restrainer selected from a mercaptotetrazole, a mercaptotriazole, a mercaptopyrimidine, a mercaptobenzimidazole, a mercaptothiadiazole, a benzotriazole and an imidazole.

23. A silver halide photographic light-sensitive material comprising a support having thereon a light-sensitive silver halide emulsion layer having associated therewith a blocked photographic agent represented by formula (I)

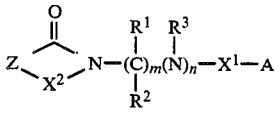

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is a developing agent selected from a p-phenylenediamine, a hydroquinone and a p-aminophenol.

24. A silver halide photographic light-sensitive material comprising a support having thereon a light-sensitive silver halide emulsion layer having associated therewith a blocked photographic agent represented by formula (I)

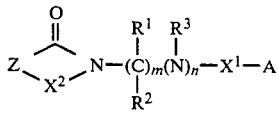

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is an auxiliary developing agent which is a pyrazolidone.

25. A silver halide photographic light-sensitive material comprising a support having thereon a light-sensitive silver halide emulsion layer having associated therewith a blocked photographic agent represented by formula (I)

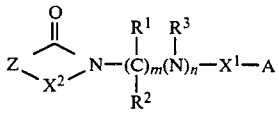

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is a fogging agent which is a hydrazine or a hydrazide.

26. A silver halide photographic light-sensitive material comprising a support having thereon a light-sensitive silver halide emulsion layer having associated therewith a blocked photographic agent represented by formula (I)

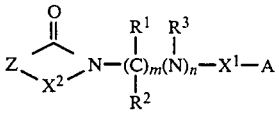

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is a silver solvent which is a thiosulfate.

27. A silver halide photographic light-sensitive material comprising a support having thereon a light-sensitive silver halide emulsion layer having associated therewith a blocked photographic agent represented by formula (I)

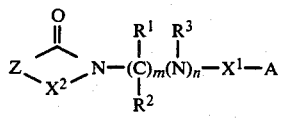

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is a bleach accelerating agent which is an aminoalkylthiol.

28. A silver halide photographic light-sensitive material comprising a support having thereon a light-sensitive silver halide emulsion layer having associated therewith a blocked photographic agent represented by formula (I)

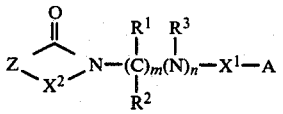

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is a dye which is an azo dye or an azomethine dye.

29. A silver halide photographic light-sensitive material comprising a support having thereon a light-sensitive silver halide emulsion layer having associated therewith a blocked photographic agent represented by formula (I)

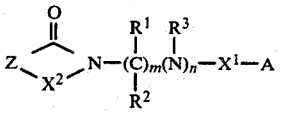

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent in the moiety represented by A is a photographic agent having a redox function so as to enable the release of photographically useful agent as a function of silver halide development.

30. A silver halide photographic light-sensitive material comprising a support having thereon a light-sensitive silver halide emulsion layer having associated therewith a blocked photographic agent represented by formula (I)

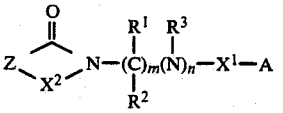

(I)

wherein A represents a photographically useful agent moiety; $X^1$ and $X^2$ each represents a carbonyl group, a sulfonyl group, or a sulfinyl group; Z represents an atomic group forming a 5-membered, 6-membered, or 7-membered ring; $R^1$ and $R^2$ each represents a hydrogen atom, a halogen atom, an alkyl group, an alkenyl group, a cycloalkyl group, an aryl group, an alkoxy group, an acyl group, a sulfonyl group, or a heterocyclic group; $R^3$ represents an alkyl group, an alkenyl group, a cycloalkyl group, a heterocyclic group, an aryl group, or an aralkyl group; m represents 0, 1, or 2; n represents 0 or 1; and the total of m+n is 1, 2, or 3, wherein the photographically useful agent moiety represented by A has a timing group and the timing group is a connecting group selected from a group which releases the photographically useful agent by an intromolecular ring-closing reaction, a group which releases the photographically useful agent through intramolecular electron transfer, a group which releases the photographically useful agent with the evolution of carbon dioxide or a group which releases the photographically useful agent with the evolution of formaldehyde.

31. A silver halide photographic light-sensitive material comprising a support having thereon a light-sensitive silver halide emulsion layer having associated therewith a blocked photographic agent, wherein the blocked photographic agent is a compound represented by formula (II):

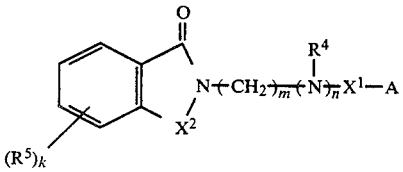

(II)

wherein A represents a photograpically useful agent moiety; $X^1$ represents a carbonyl group; $X^2$ represents a carbonyl group or a sulfonyl group; $R^4$ represents a substituted or unsubstituted alkyl group; $R^5$ represents a halogen atom, a carbonamide group, a sulfonamide group, a ureido group, a carbamoyl group, a sulfamoyl group or a nitro group; k represents 0 or 1; m represents 1 or 2; and n represents 0 or 1, and when n represents 0, m represents 2 and when n represents 1, m represents 1.

32. A silver halide photographic light-sensitive material comprising a support having thereon a light-sensitive silver halide emulsion layer having associated therewith a blocked photographic agent, wherein the blocked photographic agent is a compound represented by formula (III):

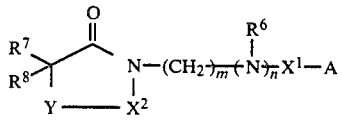

(III)

wherein A represents a photographically useful agent moiety; $X^1$ and $X^2$ each represents a carbonyl group; $R^6$ represents a substituted or unsubstituted alkyl group; $R^7$ and $R^8$ each represents a substituent selected from a hydrogen atom or a substituted or unsubstituted alkyl group; Y represents an oxygen atom or

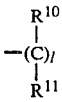

wherein $R^{10}$ and $R^{11}$ each represents a hydrogen atom and l represents 1; m represents 1 or 2, n represents 0 or 1 and when n represents 0, m represents 2, and when n represents 1, m represents 1.

33. A silver halide photographic light-sensitive material as in claim 29, wherein the photographically useful agent in the moiety represented by A is a coloring material for color diffusion transfer photographic material or a development inhibitor releasing hydroquinone.

34. A silver halide photographic light-sensitive material as in claim 32, wherein m represents 1 or 2, and n represents 0 or 1, and when n represents 0, m represents 2, and when n represents 1, m represents 1.

* * * * *